United States Patent [19]

Kazanowski et al.

[11] Patent Number: 4,980,935

[45] Date of Patent: Jan. 1, 1991

[54] BEACH TOWEL AND PILLOW REMOVABLY CONTAINED WITHIN CARRYING BAG

[75] Inventors: Roger A. Kazanowski, Walled Lake; Brian Terski, Westland, both of Mich.

[73] Assignee: Cambridge Products, Livonia, Mich.

[21] Appl. No.: 395,265

[22] Filed: Aug. 17, 1989

[51] Int. Cl.[5] ..... A47G 9/06

[52] U.S. Cl. ..... 5/419; 5/417; 190/2; 383/4

[58] Field of Search ..... 5/417–420, 5/413; 383/4, 109; 190/1, 2

[56] References Cited

U.S. PATENT DOCUMENTS

| | | | |
|---|---|---|---|
| D. 26[illegible],464 | 10/1981 | Smith | 5/419 |
| 1,677,743 | 7/1928 | Berton | 5/442 |
| 4,195,378 | 4/1980 | Parker | 5/419 |
| 4,231,125 | 11/1980 | Tittl | 5/419 |
| 4,273,380 | 6/1981 | Silvestri | 5/417 |
| 4,277,859 | 7/1981 | Seaman | 5/413 |
| 4,375,111 | 3/1983 | Hall | 5/419 |
| 4,466,516 | 8/1984 | Sicoli | 5/419 |
| 4,546,507 | 10/1985 | Weinstein | 5/417 |

FOREIGN PATENT DOCUMENTS

| | | | |
|---|---|---|---|
| 1215109 | 4/1960 | France | 383/4 |

*Primary Examiner*—Gary L. Smith
*Assistant Examiner*—F. Saether
*Attorney, Agent, or Firm*—Basile and Hanlon

[57] ABSTRACT

A beach towel comprises a towel with a hollow, open-ended receptacle integrally attached to one end of the towel. A pillow is removably disposed within the receptacle. A carrying bag has first and second ends, one of which is closed, and one of which is attached to the pillow. The bag defines a hollow enclosure extending from the first end to the second end, with the hollow enclosure removably enclosing the towel, receptacle and pillow when the towel is rolled around the pillow and not in use. A drawstring, attached to either the first or second end, is provided for closing the bag.

8 Claims, 1 Drawing Sheet

BEACH TOWEL AND PILLOW REMOVABLY CONTAINED WITHIN CARRYING BAG

BACKGROUND OF THE INVENTION

1. Field of the Invention

The present invention generally relates to beach towels, and more particularly to beach towels having a built in pillow and a waterproof carrying bag.

2. Description of the Relavant Art

In the past, sunbathers and other people enjoying a beach or poolside have had problems with being comfortable on the ground. Beach towels were used to keep the sand, dirt or other debris away from a person, but a towel alone did not make for a comfortable resting place. In particular, a conventional towel lacks a comfortable place to rest one's head. As a result, people resorted to rolling up a second towel to place under the head. This had the disadvantage of not being a very comfortable pillow, whereas even if a comfortable position was found, that configuration of the towel is easily lost when the person moves. Another solution was to bring an actual pillow and lay it on the towel. However, this was impractical because the pillow would get dirty and wet. In addition, it was inconvenient to search for and carry a separate pillow along with all the other provisions usually brought to a beach or pool.

Therefore, it would be desirable to find a beach towel with a pillow integral therewith which would not get wet or dirty, is easily carried, and which would be removable for simple cleaning of the towel.

SUMMARY OF THE INVENTION

The beach towel of the present invention meets all of the needs outlined above. The beach towel is comprised of a towel with a hollow, open-ended receptacle integrally attached at one end of the towel. A pillow is removably disposed within the receptacle. A carrying bag has first and second ends, with one of the ends being closed. Also, one of the ends is attached to the pillow. The bag defines a hollow enclosure extending from the first end to the second end. The hollow enclosure removably encloses the towel, receptacle and pillow when the towel is rolled around the pillow. The beach towel further comprises means, attached to one of the first and second ends, for closing the bag.

BRIEF DESCRIPTION OF THE DRAWINGS

Other advantages and features will become apparent by reference to the following specification and drawings in which.

DESCRIPTION OF THE PREFERRED EMBODIMENT

Figure 1:
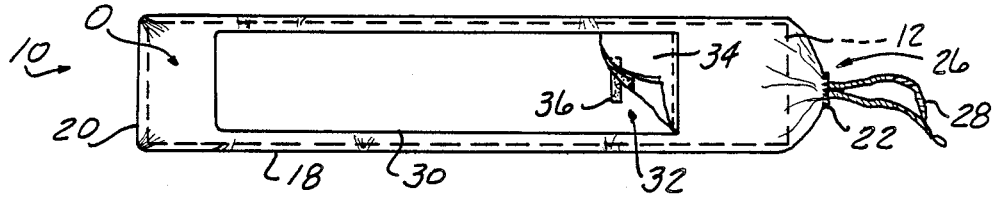
FIG. 1 is a front view showing the carrying bag with the beach towel shown disposed therein in hidden line.
Figure 2:
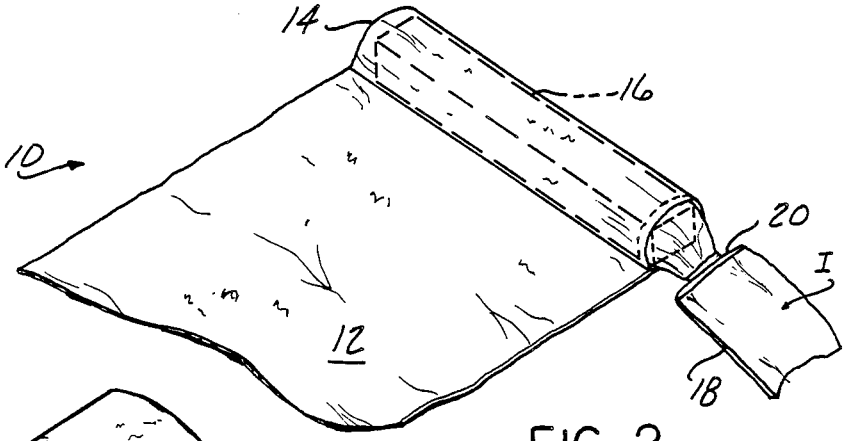
FIG. 2 is a perspective view of the beach towel of the present invention with part of the beach towel and part of the carrying bag cut away.
Figure 4:
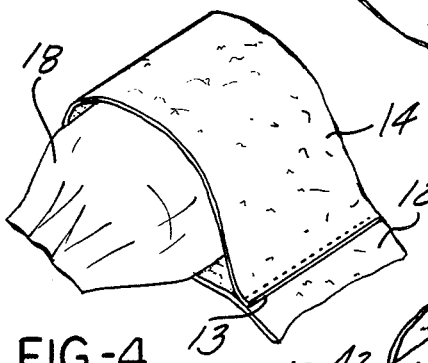
FIG. 4 is an enlarged cut away perspective view showing one end of the towel folded over to form the receptacle.

Referring now to FIG. 1, the beach towel of the present invention is designated generally as 10. The beach towel 10 is comprised of a towel 12, as best seen in FIG. 2. A hollow, open-ended receptacle 14 is integrally attached at one end of towel 12. Receptacle 14 may be formed separately and then attached by any suitable means to the towel, as shown in FIG. 3, or the receptacle 14 may be formed by folding one end 13 of towel 12 over and securing that end 13 to the towel 12 as shown in FIG. 4.

A pillow 16 is removably disposed within receptacle 14. A carrying bag 18 has a first end 20 and a second end 22. One of the first and second ends, 20 and 22 respectively, is closed and the other is opened. In addition, one of the ends 20, 22 is attached to pillow 16. In the preferred embodiment, first end 20 is closed, and is attached to pillow 16.

Figure 3:
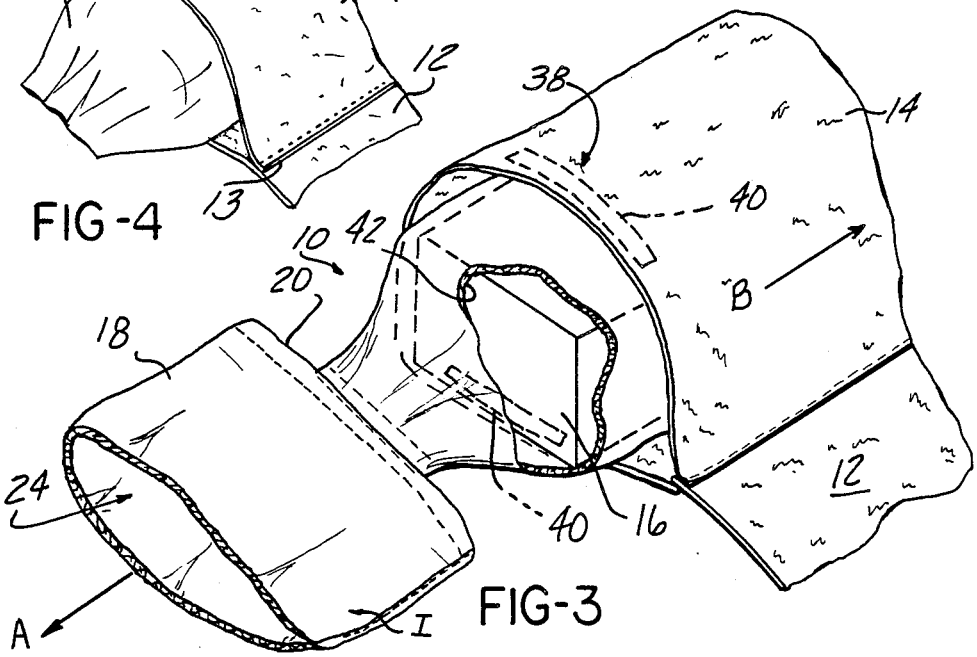
FIG. 3 is an enlarged cut away perspective view showing the second hollow enclosure partly cut away to expose the pillow.

Carrying bag 18 defines a hollow enclosure 24 as best seen in FIG. 3. Hollow enclosure 24 extends from the first end 20 to the second end 22. In the direction as designated by arrow A in FIG. 3. Hollow enclosure 24 removably encloses towel 12, receptacle 14 and pillow 16 when towel 12 is rolled around the pillow 16, as shown in FIG. 1.

In the preferred embodiment, second end 22 is reversible over carrying bag 18, to urge carrying bag 18 over itself to removably enclose the towel 12, receptacle 14 and pillow 16, when towel 12 is rolled around pillow 16. Accordingly, when carrying bag 18 enclosures towel 12, the outside of carrying bag 18 is seen, as designated by arrow 0 in FIG. 1. When carrying bag 18 does not enclose towel 12, the inside of carrying bag 18 is showing, as designated by arrow I in FIGS. 2 and 3.

Beach towel 10 further comprises means 26, attached to one of the first and second ends, 20, 22 respectively, for closing carrying bag 18. The bag closing means 26 may be comprised of any suitable means, including mating hooks and loops, snaps, or the like. In the preferred embodiment, bag closing means 26 is attached to second end 22 and comprises a drawstring 28.

In the preferred embodiment, the carrying bag 18 is made of a suitable waterproof material. This insures that the towel 12 and pillow 16 will be kept dry and clean during travel and storage. The beach towel 10 may further comprise a waterproof storage pouch 30 disposed on carrying bag 18, as seen in FIG. 1. Storage bag 30 is useful for keeping sunglasses, suntan lotion, keys and the like in a dry and safe place. Any suitable means 32 for closing pouch 30 may be used. In the preferred embodiment, pouch 30 has a flap 34 attached at one end with mating hooks and loops 36 used as the pouch closing means 32.

In order to keep the pillow 16 from falling out of receptacle 14 when not in use, there is provided means 38 for closing receptacle 14 to keep pillow 18 inside. In the preferred embodiment, the receptacle closing means 38 is comprised of mating hooks and loops 40, as seen in FIG. 3.

Beach towel 10 further comprises a second hollow enclosure 42 as seen in FIG. 3. This enclosure 42 extends from first end 20, in a direction opposite that of first hollow enclosure 24, the direction being designated by arrow B. Second hollow enclosure 42 permanently encloses pillow 16, and, in the preferred embodiment is comprised of a suitable waterproof material.

The advantage of beach towel 10 is that a sunbather has a comfortable, built-in pillow 16 integral with his towel 12. Since pillow 16 is encased within a waterproof enclosure 42, pillow 16 stays dry and clean. Yet, since the pillow 16 is also removable, towel 12 can be easily washed without fear of destroying pillow 16 in a washing machine. Since carrying bag 18 is always attached to pillow 16, there is no chance of losing the bag 18.

It is to be understood that the foregoing description is merely exemplary and not limitative, and the true scope of the invention is that described in the following claims.

What is claimed is:

1. A beach towel, comprising:

a towel;

a hollow, open-ended receptacle integrally attached at one end of the towel;

a pillow removably disposed within the receptacle;

a carrying bag having first and second ends and defining a hollow enclosure extending from the first end to the second end, the first end being closed and attached to the pillow, and the second end being reversible over the carrying bag, to urge the carrying bag over itself to removably enclose the towel, receptacle, and pillow within the hollow enclosure, when the towel is rolled around the pillow;

a second hollow enclosure extending from the first end, in a direction opposite the first hollow enclosure, the second hollow enclosure permanently enclosing the pillow; and means, attached to the second end, for closing the bag.

2. The beach towel as defined in claim 1 wherein the carrying bag is waterproof.

3. The beach towel as defined in claim 1 further comprising:

a waterproof storage pouch disposed on the bag; and means for closing the pouch.

4. The beach towel as defined in claim 1 further comprising means for closing the receptacle for keeping the pillow within the receptacle.

5. The beach towel as defined in claim 3 wherein the pouch closing means is comprised of mating hooks and loops.

6. The beach towel as defined in claim 4 wherein the receptacle closing means is comprised of mating hooks and loops.

7. The beach towel as defined in claim 1 wherein the receptacle is formed by folding one end of the towel over and securing the end to the towel.

8. A beach towel comprising:

a towel;

a hollow, open-ended receptacle, formed by folding one end of the towel over and securing the end to the towel;

a pillow removably disposed within the receptacle;

mating hooks and loops, attached at the open end of the receptacle, for closing the receptacle to keep the pillow within the receptacle;

a waterproof carrying bag having a closed first end and an open second end, the bag defining a hollow enclosure extending from the first end, which is attached to the pillow, to the second end, the second end being reversible over the carrying bag, to urge the carrying bag over itself to removably enclose the towel, receptacle and pillow, when the towel is rolled around the pillow;

a drawstring, attached to the second end of the bag for closing the bag;

a waterproof storage pouch disposed on the bag, the pouch having a closing flap;

mating hooks and loops disposed on the pouch and on the flap, for closing the pouch; and a waterproof second hollow enclosure extending from the first end, in a direction opposite the first hollow enclosure, the second hollow enclosure permanently enclosing the pillow.

* * * * *